US008065997B2

(12) United States Patent
Lee et al.

(10) Patent No.: US 8,065,997 B2
(45) Date of Patent: Nov. 29, 2011

(54) HEATING COOKING APPLIANCE

(75) Inventors: Dae Rae Lee, Ginhae-si (KR); Jung Wan Ryu, Changwon-si (KR); Dae Bong Yang, Jinhae-si (KR); Sang Min Lyu, Changwon-si (KR); Yong Ki Jeong, Busan (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 11/953,682

(22) Filed: Dec. 10, 2007

(65) Prior Publication Data

US 2008/0149092 A1 Jun. 26, 2008

(30) Foreign Application Priority Data

Dec. 20, 2006 (KR) ..... 10-2006-0130611
Jan. 23, 2007 (KR) ..... 10-2007-0007104

(51) Int. Cl.
*F24C 3/06* (2006.01)
*F24C 15/10* (2006.01)
*F23Q 9/00* (2006.01)

(52) U.S. Cl. ..... 126/39 J; 126/39 H; 431/285

(58) Field of Classification Search ..... 126/39 J, 126/39 H; 431/285
See application file for complete search history.

(56) References Cited

U.S. PATENT DOCUMENTS

| | | | | | |
|---|---|---|---|---|---|
| 1,978,544 | A | * | 10/1934 | Maul | 236/15 A |
| 3,843,313 | A | * | 10/1974 | Helgeson | 431/329 |
| 4,067,681 | A | * | 1/1978 | Reid et al. | 431/10 |
| 4,580,550 | A | * | 4/1986 | Kristen et al. | 126/39 J |
| 5,139,007 | A | * | 8/1992 | Bertomeu Martinez | 126/39 J |
| 5,402,767 | A | * | 4/1995 | Kahlke | 126/39 D |
| 5,509,403 | A | * | 4/1996 | Kahlke et al. | 126/39 E |
| 6,037,572 | A | * | 3/2000 | Coates et al. | 219/451.1 |
| 6,067,980 | A | * | 5/2000 | Kahlke et al. | 126/214 R |
| 6,076,517 | A | * | 6/2000 | Kahlke et al. | 126/39 J |
| 6,103,338 | A | * | 8/2000 | Gille et al. | 428/121 |
| 6,230,701 | B1 | * | 5/2001 | Schultheis et al. | 126/39 J |
| 6,732,729 | B2 | * | 5/2004 | Yeung | 126/299 D |
| 7,057,139 | B2 | * | 6/2006 | McWilliams | 219/467.1 |
| 2009/0173333 | A1 | * | 7/2009 | Kwon et al. | 126/39 E |

FOREIGN PATENT DOCUMENTS

| | | | |
|---|---|---|---|
| CN | 2342258 | Y | 10/1999 |
| KR | 2003-0093570 | * | 12/2003 |
| KR | 2003-0093570 | A | 12/2003 |

* cited by examiner

*Primary Examiner* — Steven B McAllister
*Assistant Examiner* — Frances H Kamps
(74) *Attorney, Agent, or Firm* — Birch, Stewart, Kolasch & Birch, LLP

(57) ABSTRACT

A heating cooking appliance is provided. The heating cooking appliance includes a case, a plate, a burner system, and a warm zone guide. The plate covers the top of the case. The burner system is provided below the plate and defines a heating region on the plate. The heating region heats food. A warm zone guide defines a warm zone region on the plate through exposing at least a portion of an undersurface of the plate to combustion gas generated from the burner system during exhausting of the combustion gas.

8 Claims, 15 Drawing Sheets

HEATING COOKING APPLIANCE

CROSS-REFERENCE TO RELATED APPLICATIONS

The present application claims priority under 35 U.S.C. 119 and 35 U.S.C. 365 to Korean Patent Application No. 10-2006-0130611 (filed on Dec. 20, 2006) and 10-2007-0007104 (filed on Jan. 23, 2007, which are hereby incorporated by reference in their entirety.

BACKGROUND

The present disclosure relates to a heating cooking appliance.

A heating cooking appliance is an apparatus that heats and cooks food. The present disclosure particularly addresses a gas cook top that generates heat through gas combustion to heat and cook food. This cook top, which employs a hot plate (also referred to as a 'nob'), is gaining increasing popularity.

A cook top includes a burner system in which gas is combusted, and the heated air is used to heat the hot plate. Food in a vessel atop the hot plate is cooked by heat radiated from the hot plate.

However, heating cooking appliances according to the related art only have a heating function to heat food at high temperatures and do not incorporate a warming function to keep food warm. Unlike oven ranges with a warming drawer below the stovetop to keep food warm, related art heating cooking appliances lack this convenient function.

SUMMARY

Embodiments provide a heating cooking appliance provided with a function that preserves food on the heating cooking appliance by heating a plate. In one embodiment, a heating cooking appliance includes: a case; a plate covering a top of the case; a burner system provided below the plate and defining a heating region on the plate, the heating region heating food; and a warm zone guide defining a warm zone region on the plate through exposing at least a portion of an undersurface of the plate to combustion gas generated from the burner system during exhausting of the combustion gas.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

First Embodiment

Figure 1:
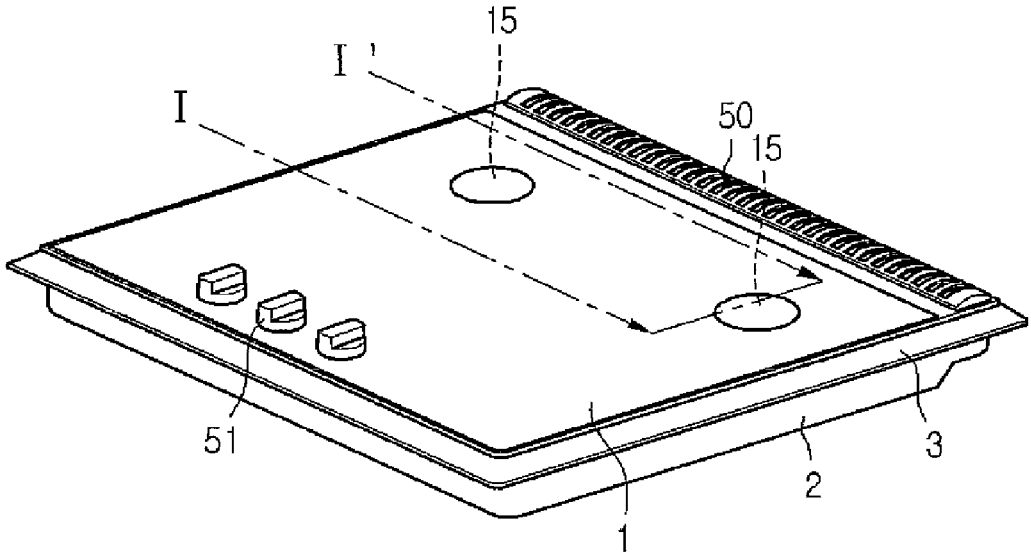
FIG. 1 is a perspective view of a heating cooking appliance according to the first embodiment.
Figure 2:
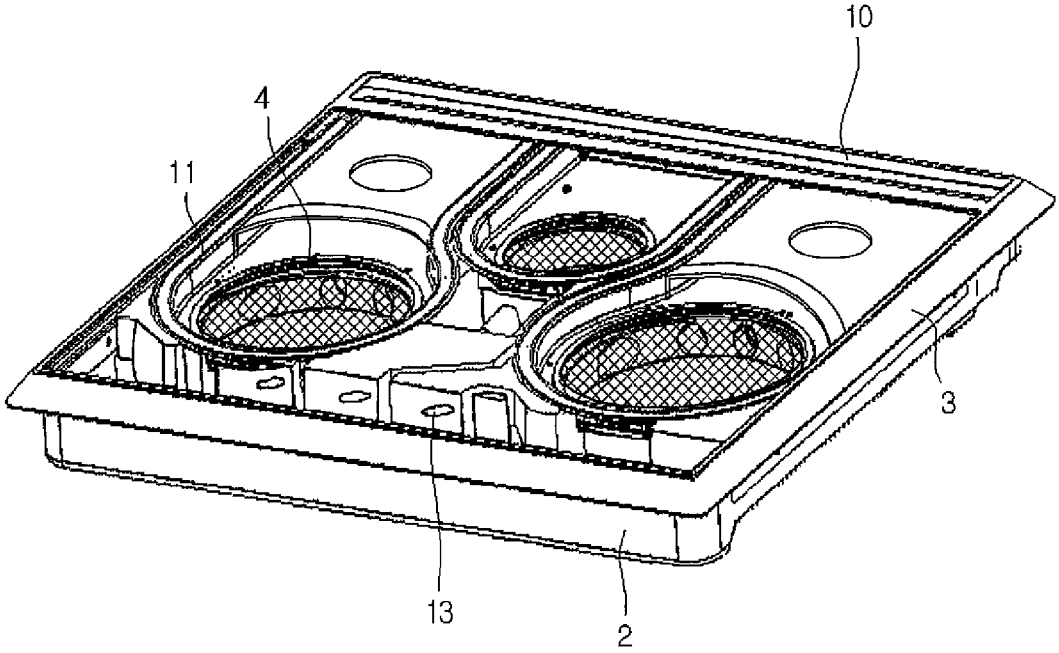
FIG. 2 is a perspective view of a heating cooking appliance in FIG. 1 with the ceramic plate removed.
Figure 3:
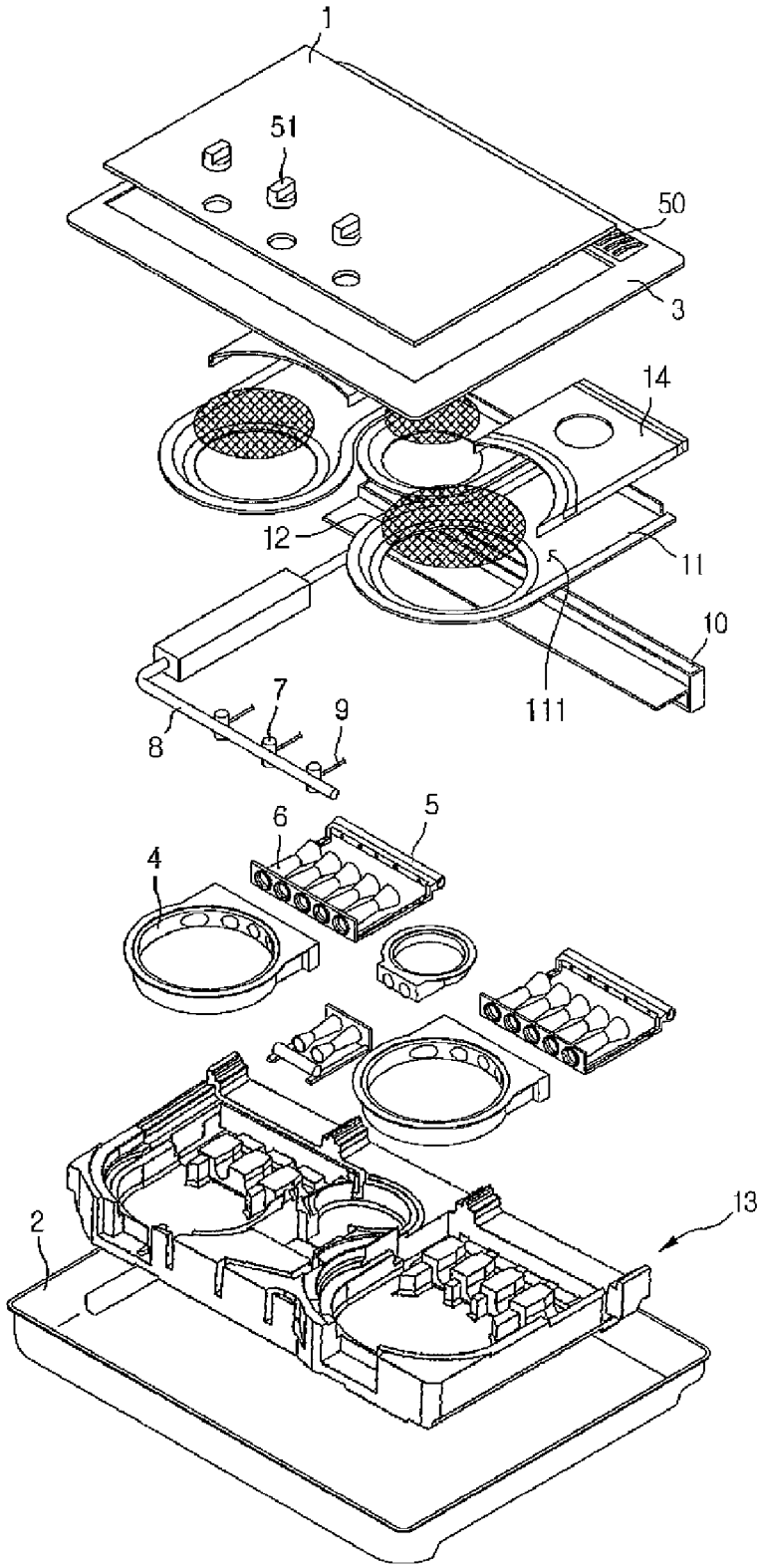
FIG. 3 is an exploded perspective view of the heating cooking appliance in FIG. 1.

FIG. 1 is a perspective view of a heating cooking appliance according to the first embodiment, FIG. 2 is a perspective view of a heating cooking appliance in FIG. 1 with the ceramic plates removed, and FIG. 3 is an exploded perspective view of the heating cooking appliance in FIG. 1.

Referring to FIGS. 1 through 3, a heating cooking appliance according to the first embodiment includes a case 2 that forms the outer appearance of the lower portion of the appliance and has an open upper side, a ceramic plate 1 mounted on the upper side of the case 2, and a top frame 3 covering the peripheral portion of the ceramic plate 1.

Also, added external features of the heating cooking appliance include an exhaust grill 50 formed at the rear portion of the cooking appliance for exhausting combusted gas, and a switch 51 formed at the approximate frontal portion of the ceramic plate 1 for on/off controlling of gas combustion.

While the location and shape of the exhaust grill 50 and the switch 51 be varied in configuration and type, an exhaust for exhausting combusted gas and a switch for performing the on/off controlling of combusting gas are, of course, required.

The internal space defined by the case 2 and the ceramic plate 1 holds a plurality of components for performing gas combustion and exhausting, and controlling of the cooking appliance. A configurative description of the inside will be given.

First, three burner pots 4 are provided in the internal space to sufficiently mix gas with air to allow uniform combustion afterward. A mixing tube unit 6 is disposed on the side surface of each burner pot 4 to supply a gas mixture through the side surface of the burner pot 4.

Also, a nozzle unit 5 is disposed at a uniform distance from the mixing tube unit 6, and discharges gas toward the inlets of the mixing tube unit 6.

A burner frame 11 is disposed on top of the burner pots 4. The burner frame 11 supports the positions of the burner pots 4 and provides an exhaust passage 111 for exhausting spent gas combusted on a glow plate 12. Here, the burner frame 11 partitions only the lower part of the exhaust passage 111. A separate warm zone guide 14 is provided to define at least a portion of the top surface of the exhaust passage 111. The warm zone guide 14 performs a warm zone function in a region of the ceramic plate 1—that is, a region corresponding to an opening 16. In order to accurately designate the region of the ceramic plate 1 in which the warm zone function is performed, a warm zone indicator 15 may be displayed in a predetermined manner on the region of the ceramic plate 1 aligned vertically with the opening 16. The warm zone function is lower than a temperature suitable for heating and cooking, and maintains the ceramic plate 1 at a temperature suitable for preserving and warming food.

An exhaust unit 10 for externally exhausting spent gas is disposed at the rear of the burner frame 11, and the exhaust grill 51 is disposed above the exhaust unit 10.

The glow plate 12 is disposed on the open upper side of the burner pot 4, and the glow plate 12 is heated at high temperatures generated by the combusting of the air-gas mixture. When the glow plate 12 is heated, radiant energy in a frequency range corresponding to the physical properties of the glow plate 12 is emitted.

The radiant energy of the glow plate 12 includes at least visible light frequencies, so that a user can perceive, by means of the visible light, that the heating cooking appliance according to the present disclosure is operating. Of course, the glow plate 12 also functions to heat food, and to heat the ceramic plate 1 that also heats food.

A heat insulator 13 is provided below the burner pots 4 to simultaneously support each burner pot 4 and prevent combustion heat generated when gas mixture combusts from being transferred to the outside. The heat insulator 13 will be described with reference to the drawings.

A description of the structure for supplying gas to the nozzle unit 5 will be given.

Gas from the outside is supplied through a main gas supply line 8 to the heating cooking appliance, and the supply of gas to each burner system is mediated through a gas valve 7 (which is controlled by the switch 51). After passing through the gas valve 7, the gas passes through a respective branch gas supply line 9 to each of the nozzle units 5.

Here, in order for the burner system to supply and combust a gas mixture, it may include at least a nozzle unit 5, a mixing tube unit 6, a burner pot 4, and a glow plate 12.

Figure 4:
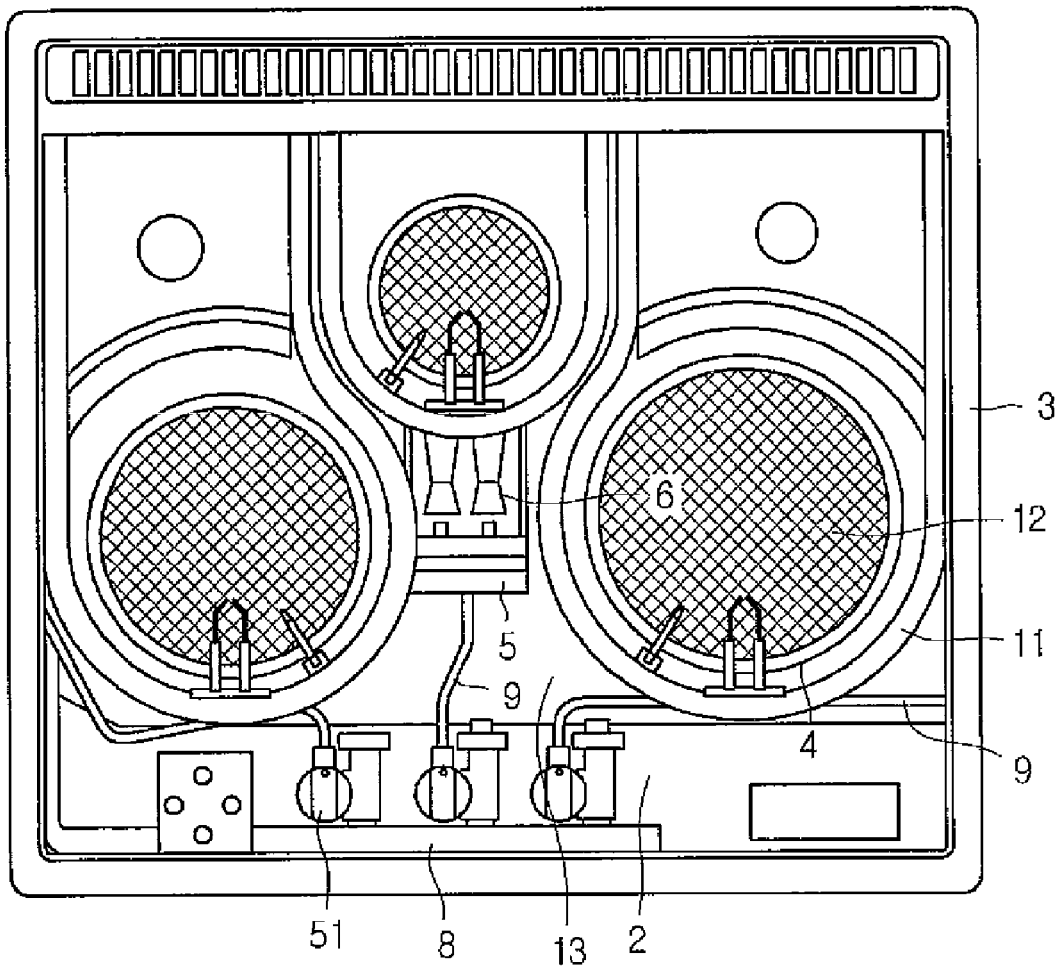
FIG. 4 is a plan view of the heating cooking appliance in FIG. 1.

FIG. 4 is a plan view of the heating cooking appliance in FIG. 1.

Referring to FIG. 4, there are two comparatively large burner pots 4 disposed at each side of the case 2, and a smaller burner pot 4 provided between the two larger burner pots 4. Thus, food vessels of corresponding heating sizes are placed over the respective burner pots 4 to heat food within the vessels.

The smaller-sized burner pot 4 in the center of the case 2 is supplied with gas-air mixture from front to rear, and the mixture of air and gas is completely mixed in a second stage within the burner pot. After the gas mixture is combusted on the glow plate 12, the spent gas is exhausted through the exhaust unit 10 at the rear.

On the other hand, the two comparatively larger burner pots 4 on either side of the case 2 are supplied with gas and air from rear to front. After the gas mixture is mixed in a second stage within the burner pot, the mixture is combusted on the glow plate 12 and then exhausted toward the rear of the burner pot 4.

The above arrangement of the burner pots 4 is intended to optimally configure a heating burner system. Also, FIG. 4 provides easy visual access to the internal arrangement of each component in the heating cooking appliance.

The combusted gas is exhausted rearward through an exhaust passage 111 defining a gap between the warm zone guide 14 and the burner frame 11. However, because the combusted gas flowing through the exhaust passage 111 that has already been used for heating food is still at a high temperature of several hundred ° C., the ceramic plate 1 aligned vertically with the exhaust passage 111 is also heated to several hundred ° C. According to tests, when warm zone guides 14 are absent, the ceramic plate 1 reaches 200° C.

When the region of the ceramic plate 1 aligned vertically to the exhaust passage 111 attains this high temperature, a user, believing that only the regions of the glow plates 12 will be hot, may contact other regions of the ceramic plate—namely, the regions vertically aligned with the exhaust passage 111—and sustain burns.

This compromise in safety can be prevented by the warm zone guide 14.

Thus, the warm zone guide 14 performs a primary function of sustaining a designated region (i.e., a warm zone region) of the ceramic plate 1 at a temperature suitable for warming food, and a secondary function of preventing the heat passing through the exhaust passage 111 from being transferred to the ceramic plate 1 in order to increase the margin of user safety.

Figure 5:
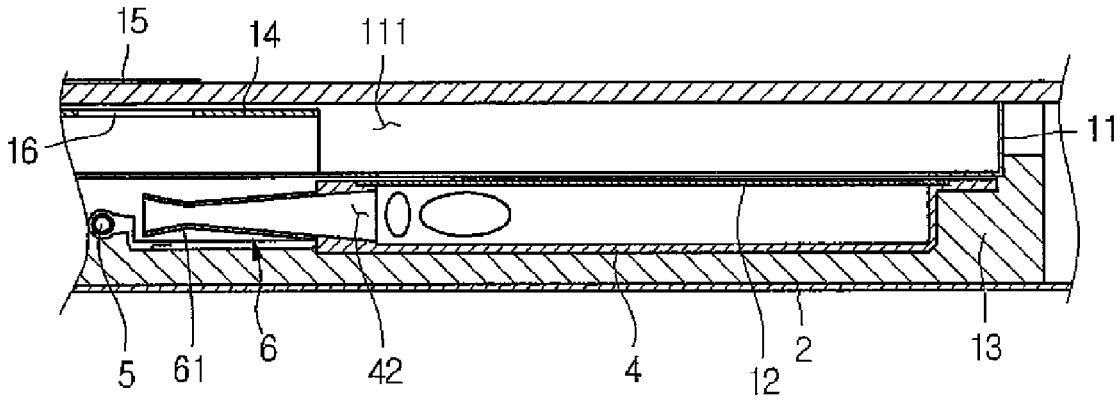
FIG. 5 is a sectional view of the heating cooking appliance cut along line I-I'.

FIG. 5 is a sectional view of the burner system in FIG. 1 taken along line I-I'.

Referring to FIG. 5, a burner pot 4 is provided at the top of the case 2. The mixing tube unit 6 is disposed on the side surface of the burner pot 4. The nozzle unit 5 is disposed at a predetermined distance from the mixing tube unit 6 to be proximate to the inlets of the mixing tube unit 6. The glow plates 12 are disposed above the burner pots 4, and the exhaust passage 11 for exhausting combusted gas is provided to the rear of the glow plates 12. The exhaust passage 111 is a space defined between the burner frame 11 and the warm zone guide 14.

Here, the mixing tube unit 6 is aligned with the openings 42 of the burner pot 4. Also, because the mixing tubes 61 and the openings 42 provided on the mixing tube unit 6 are mutually provided in plurality to respectively align, the amount of air that enters along with the gas is maximized. The alignment of the mixing tube unit 6 and the openings 42 will be described below.

The mixing tube 61, when starting at the end of its inlet, initially provides a nozzle shape that gradually narrows in diameter, and then adopts the shape of a diffuser from the diametrically narrowest point to expand conically outward.

The continuance between the diffuser portion of the mixing tube 61 and the diametrically increasing section of the opening 42 may be employed to reduce airflow resistance. That is, the diffusion angle of the air and the mixing tube 61 may be the same.

A description on the effects of the burner system will be given.

The gas discharged from the nozzle unit 5 enters the mixing tube unit 6 at high speed. Here, because the gas passes at high speed through the inlet of the mixing tube unit 6, the neighboring region of the opening of the mixing tube unit 6, according to Bernoulli's Theorem, becomes low in pressure. Therefore, outside air also enters the mixing tube 61, and the vapor that passes through the mixing tube 61 becomes a mixture of gas and air. The gas mixture that passes through the mixing tube unit 6 passes through the openings 42 and enters the interior of the burner pot 4, after which it is mixed a second time to combust on the glow plate 12.

Also, the combustion heat from the gas mixture heats the glow plate 12 to make the glow plate 12 glow red and generate radiant heat.

Here, a large number of tiny holes are formed in the glow plate 12, through which the gas mixture passes and combusts, and spent gas is exhausted through the exhaust passage 111 and guided to the exhaust unit 10.

As already described above, when the combusted gas that passes through the exhaust passage 111 is several hundred degrees Celsius. When the heat from this combustion gas is transferred to the ceramic plate 1, the safety of a user may be compromised. Therefore, the warm zone guide 14 is provided below the ceramic plate 1. Here, an opening 16 is defined in a predetermined portion the warm zone guide 14, and combusted gas passes through the opening 16 to heat the undersurface of the ceramic plate 1 exposed to the exhaust passage 111, thereby maintaining a uniform temperature.

In this manner, the heat that can be transferred to the ceramic plate by means of the warm zone guide 14 can be prevented from being conducted elsewhere, and only a certain region of the ceramic plate can be warmed to a temperature suitable for warming food, in order to warm food.

To allow the warm zone guide 14 to properly function, the warm zone guide 14 may be made of a metal material with high thermal conductance.

Figure 6:
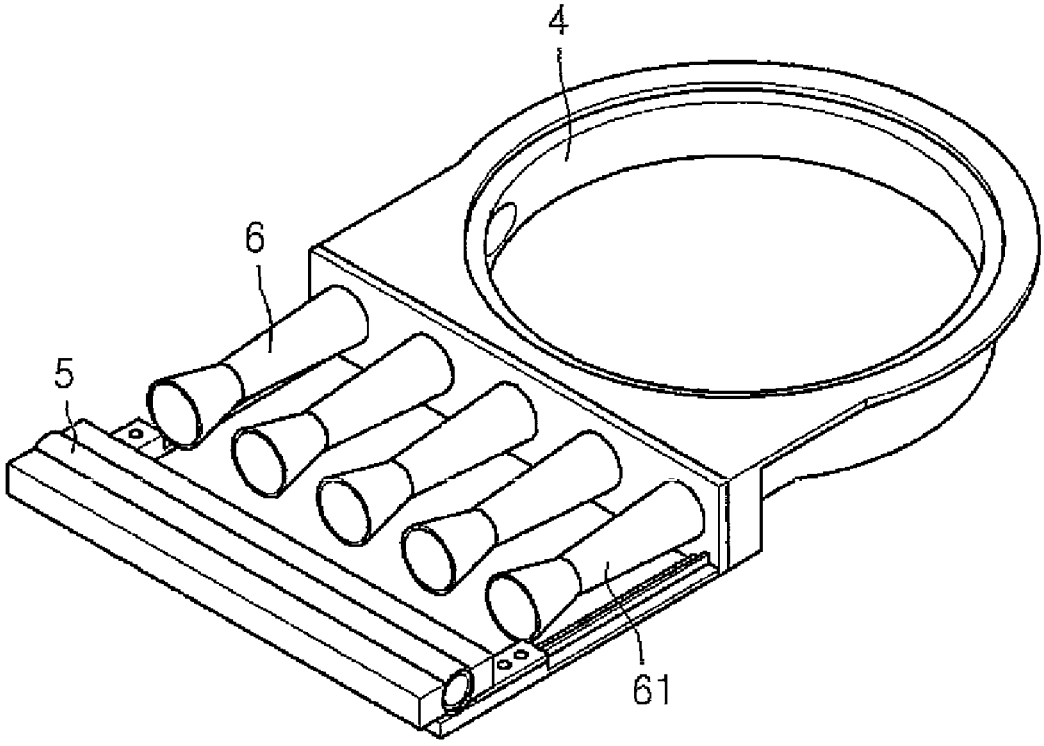
FIG. 6 is perspective view of a burner system according to the first embodiment.

FIG. 6 is a perspective view of a burner system according to the first embodiment.

Referring to FIG. 6, as already described, the mixing tube unit 6 is coupled to one side of the burner pot 4. A plurality of mixing tubes 61 is provide on the mixing tube unit 6, and a plurality of openings 42 aligned with the mixing tubes 61 is formed in the burner pot 4. Also, a nozzle unit 5 is disposed a predetermined distance from the inlet of the mixing tube unit 6.

The nozzle unit 5 is straightly formed because the plurality of inlets formed on the mixing tube unit 6 is arranged in a straight line, unlike the circular burner pot 4. Therefore, the arrangement of the burner system may become more compact.

Thus, because a plurality of mixing tubes 61 are provided horizontally in alignment with the mixing tube unit 6, the amount of air that enters along with the gas discharged from the nozzle unit 5, or the air ratio, can be increased.

In other words, by installing a plurality of mixing tubes 61, a large amount of air is suctioned into each mixing tube 61 along with the gas. The difference between the above suctioning of a large volume of air, and suctioning gas through a single mixing tube 61 becomes readily apparent.

For example, in the case where gas is suctioned through a single mixing tube, only the atmosphere around the single mixing tube is of low pressure so the air in that vicinity is suctioned; however, when gas is suctioned through a plurality of mixing tubes, the total volume from which air enters increases, so that the combined amount of air suctioned through all of the mixing tubes is greater.

The mixing tubes 61 of the mixing tube unit 6 are provided at the same height in alignment. Of course, the centers of alignment may be slightly offset, but they remain substantially aligned. As such, by providing aligned mixing tubes 61, the gas mixture entering the inside of the burner pot 4 collides together generating greater vortices, further mixing the air and gas and therefore raising the combustion efficiency of the gas. A limit to height discrepancies of the mixing tubes 61 is imposed because the height at which the mixing tubes 61 can be disposed is restricted by how the openings 42 may be formed.

The directions in which the mixing tubes 61 extend may be the same direction. That is, the lines of extension for the mixing tubes 61 may not intersect one another. Therefore, as described above, the gas mixture that enters the burner pot 4 from different mixing tubes is able to promote the creation of vortices, so that the manufacturing process of the mixing tube unit 6 is simplified, and the manufacturing process of the nozzle unit 5 aligned with the mixing tube unit 6 can also be made simpler and easier.

In addition, the number of mixing tubes 61 provided on the mixing tube unit 6 is five, as shown in the diagrams. Under the above circumstances, the mixing tube configuration may be one where the mixing tubes 61 are aligned and evenly divided across the diameter of the burner pot, and the outermost mixing tubes 61 are substantially disposed at the ends of the burner pot diameter, in order to improve the mixing efficiency of the gas mixture entering the burner pot 4. This is because the formation of vortices within the burner pot is facilitated.

Figure 7:
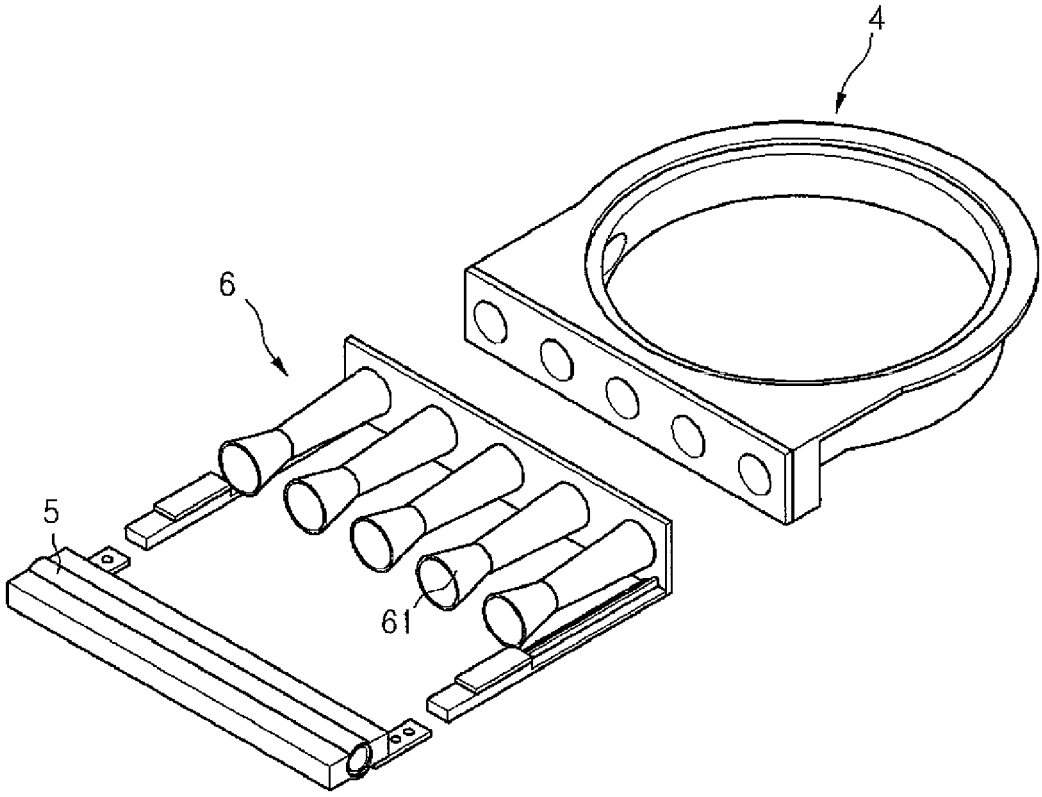
FIG. 7 is an exploded perspective view of the burner system in FIG. 6.

FIG. 7 is an exploded perspective view of the burner system in FIG. 6.

Referring to FIG. 7, the burner system according to the second embodiment includes a burner pot 4 provided with a round recessed portion for thoroughly mixing air and gas suctioned through the mixing tube unit 6, and the mixing tube unit 6 coupled at one side of the burner pot 4. Five mixing tubes are provided on the mixing tube unit 6.

Thus, because the mixing tube unit 6 is integrally formed, when it is fastened once to the burner pot 4, the five mixing tubes are aligned simultaneously. Therefore, there is little possibility that the mixing tubes 61 become misaligned with the openings 42, the mixing tubes 61 become misaligned with the nozzle unit 5, and the distances between the respective inlets of the mixing tubes 61 and the nozzle unit 5 become different so that the amount of gas and air entering the respective mixing tubes 61 become different. Compared to visually aligning each of the plurality of mixing tubes fastened to the nozzle unit 5 on the respective openings, the above embodiment is more precise.

The effects of the above integrally formed mixing tube unit 6 is that even when there is a slight offset between the centers of the discharge holes on the nozzle unit 5 for discharging gas and the inlets of the mixing tubes 61, there is substantially less possibility of a reduced low pressure region brought about by a larger offset of a discharge hole from the centers of a mixing tube inlet, which causes a drastic reduction of efficiency in air entering the inlet.

By thus fastening the mixing tube unit 6 to the burner pot 4, manufacturing and assembling efficiency can be achieved, the seal between the mixing tube unit 6 and the burner pot 4 can be improved, and the rate of defects and material costs can be lowered.

The above method of fastening each mixing tube 61 to the mixing tube unit 6 may employ the method of fastening the plurality of mixing tubes 61 to the mixing tube unit 6 while supported on a predetermined jig, or alternately, providing the plurality of mixing tubes 61 on the mixing tube unit 6 integrally from the start.

Because the inlets of the plurality of mixing tubes 61 can be aligned when fastening the mixing tubes 61 to the mixing tube unit 6 using a predetermined jig, the distances between the nozzle unit 5 and the inlets of the plurality of mixing tubes 61 can be comparatively uniform.

Figure 8:
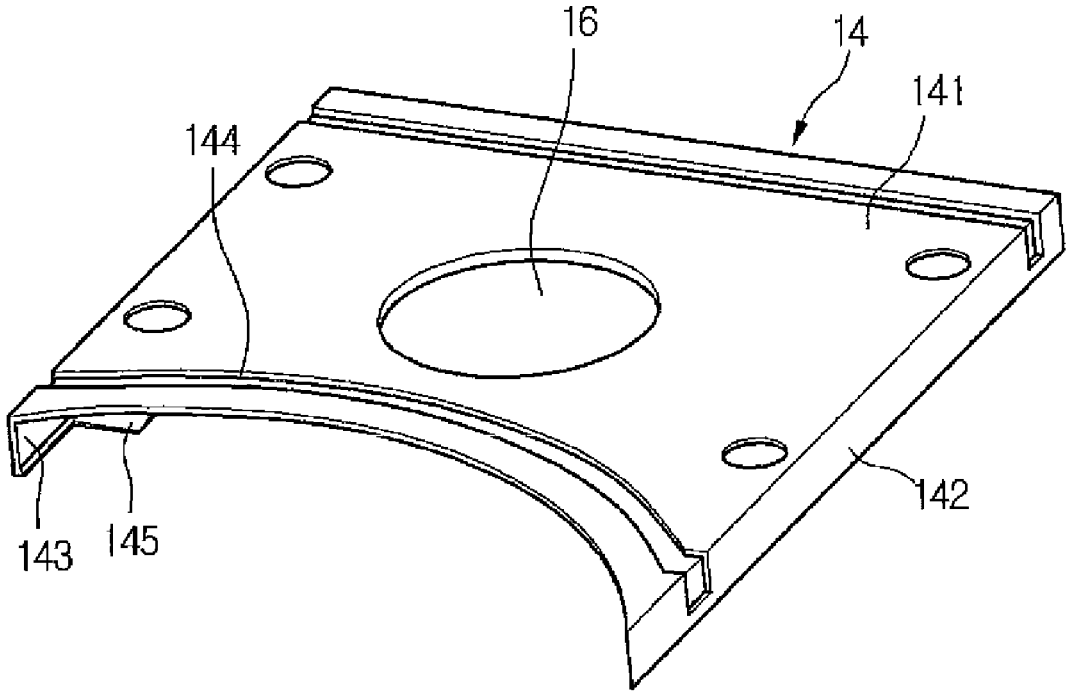
FIG. 8 is perspective view of a warm zone guide according to the first embodiment.

FIG. 8 is perspective view of a warm zone guide according to the first embodiment.

Referring to FIG. 8, the warm zone guide 14 includes an upper wall 141, a left wall 143, a right wall 142, and a lower wall 145. Here, the upper wall 141 functions to prevent the heat from the combusted gas from being directly transferred to the ceramic plate 1 by blocking it in a primary stage. The left wall 143 and the right wall 142 support the upper wall 141 at a predetermined height by contacting the burner frame 11.

Of course, the left wall 143 and the right wall 142 can also absorb heat from the upper wall 141 to conduct the heat to the burner frame 11 and other proximate regions.

In order to increase the heat transfer efficiency of the warm zone guide 14 and evenly support the warm zone guide 14, the lower wall 145 may be large in size. If the thermal conductance of the warm zone guide 14 is sufficient, the lower wall 145 may be omitted.

An opening 16 is defined in the upper wall 141 of the warm zone guide 14. The combustion gas directly contacts the undersurface of the ceramic plate 1 through the opening 16. Thus, the region of the ceramic plate 1 that is aligned with the opening 16 is heated by the combustion gas and defines a warm zone region.

To maintain the integral strength of the warm zone guide 14, a plurality of reinforcing portions 144 are provided on the upper wall 141.

The front end of the warm zone guide 14 is formed in a curved shape corresponding to the shape of the burner pot 4. Other portions of the warm zone guide 14 are provided in shapes corresponding to the shape of the burner frame 11.

The temperature distribution curves taken laterally across the ceramic plate 1 will be referred to in the following description of the warm zone formed by the warm zone guide 14.

Figure 9:
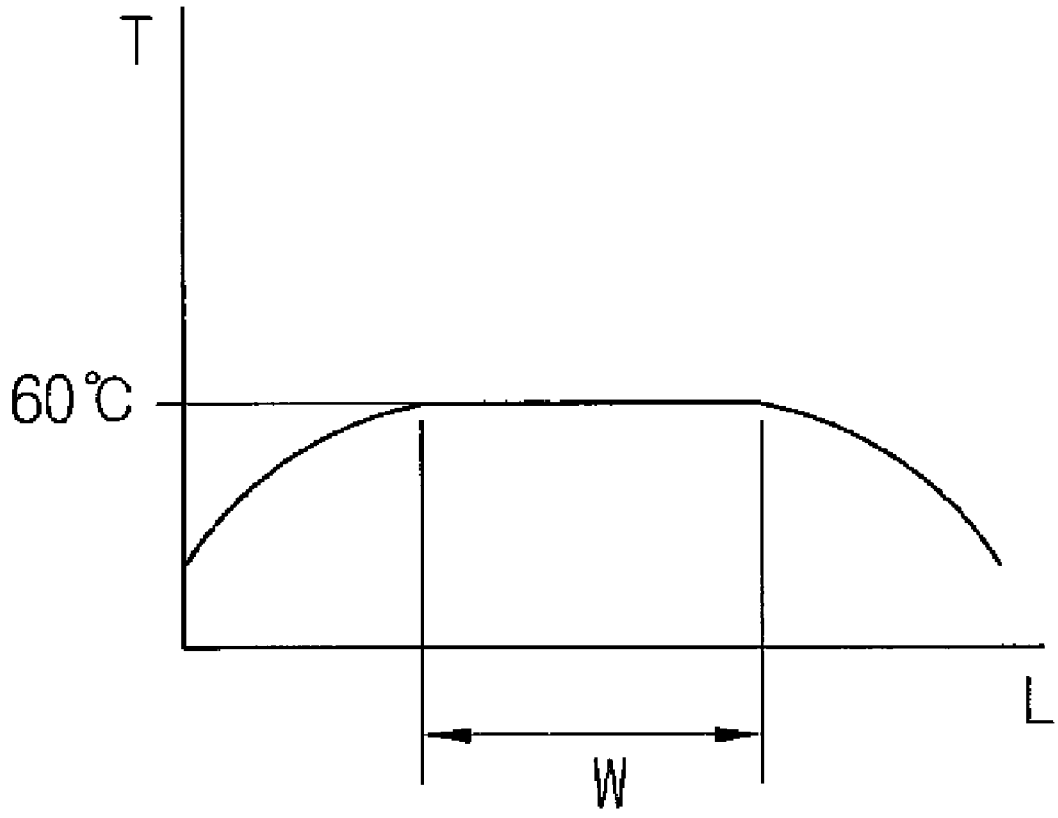
FIG. 9 is a graph showing temperature distribution measurements of a ceramic plate laterally to exhaust passages, when a warm zone guide according to the first embodiment is applied.
Figure 10:
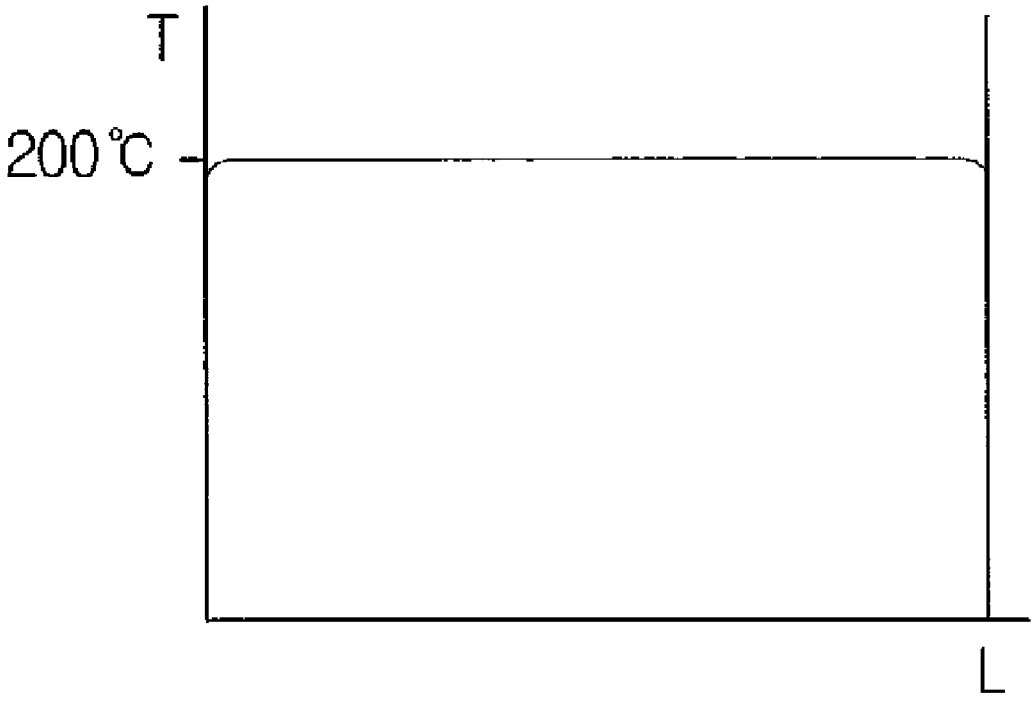
FIG. 10 is a graph showing temperature distribution measurements of a ceramic plate laterally to exhaust passages, when a warm zone guide according to the first embodiment is not applied.

FIG. 9 is a graph showing temperature distribution measurements of a ceramic plate laterally to exhaust passages, when a warm zone guide according to the first embodiment is applied; and FIG. 10 is a graph showing temperature distribution measurements of a ceramic plate laterally to exhaust passages, when a warm zone guide according to the first embodiment is not applied.

Referring to FIGS. 9 and 10, when a warm zone guide 14 is not installed, the combustion gas directly heats the entire ceramic plate 1, so that the surface temperature of the ceramic plate 1 is approximately 200° C. Under these high temperature conditions, a user will suffer burns if bodily parts are brought into contact with the ceramic plate 1. Because the entire area of the ceramic plate 1 that is vertically aligned with the exhaust passage 11 is hot, the danger of sustaining burns increases. Furthermore, because the heat is it conducted to the edges of the ceramic plate 1, heat may be conducted from the top frame 3 to kitchen furnishings, discoloring or even burning the furnishings.

Conversely, when a warm zone guide 14 is employed, the combustion gas contacts the ceramic plate 1 only through the opening 16. Therefore, the warm zone region—the warm zone indicator 15 in FIG. 1—aligned with the opening 16 has a width (W) that is directly heated, while the temperature of the remaining regions drops drastically in an outward direction from the warm zone region.

Here, while combustion gas is required to directly warm the opening 16 region of the ceramic plate 1, the temperature of ceramic plate 1 at the opening 16 can be maintained at approximately 60° C. This is because the heat is quickly dissipated through the inner material of the ceramic plate 1 to other areas.

Heat from combustion gas directly contacting the warm zone guide 14 is dissipated to other regions through the left wall 143, the right wall 142, and the lower wall 145, so that it is not used to heat the ceramic plate 1. Of course, the heat of upper wall 141 may be transferred through radiation to the underside of the ceramic plate 1. However, because the heat is transferred through radiation (and not directly through conduction) to the ceramic plate 1, it is either transmitted externally from the ceramic plate 1 or is cooled to a certain degree in the gap between the ceramic plate 1 and the upper wall 141, so that it does not have a large thermal effect on the ceramic plate 1.

In this manner, with the use of a warm zone guide 14 according to the present disclosure, because warming of the ceramic plate 1 occurs in only certain regions the remaining regions of the ceramic plate 1 that do not directly heat food are maintained at a safe temperature. Of course, food and cookware can be placed on a certain warm zone region to keep food at a constant temperature, so that users are given a higher level of convenience.

Figure 11:
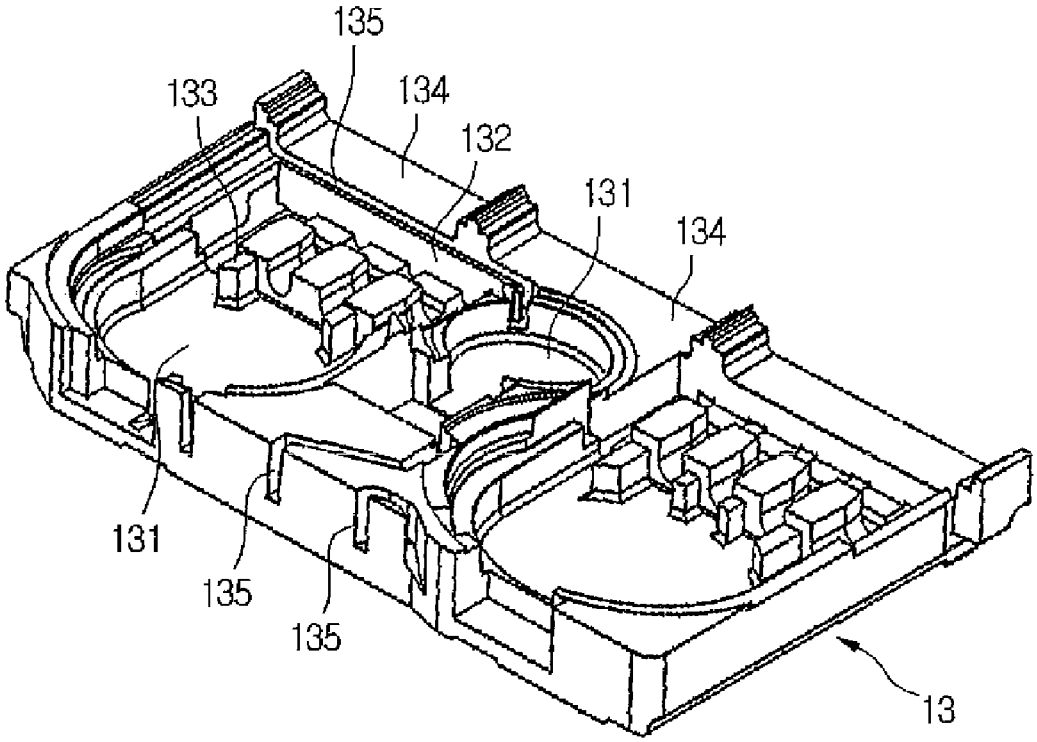
FIG. 11 is a perspective view of a heat insulator according to the first embodiment.

FIG. 11 is a perspective view of a heat insulator according to the first embodiment.

Referring to FIGS. 2 and 11, a heat insulator 13 according to the present embodiment is singularly provided within the heating cooking appliance, and simultaneously supports each burner pot 4, the nozzle unit 5, mixing tube unit 6, and burner frame 11 in the case 2.

In detail, the heat insulator 13 may include ceramic material for blocking the transfer of heat generated from the combusted gas in the burner system to the outside of the case 2. The heat insulator 13 may be formed by molding or through other means.

The overall thickness of the heat insulator 13 may be within a range that allows the burner system to be mounted on the heat insulator 13 without having the top of the burner system protrude outside the case 2.

In order to mount the burner pots 4, the nozzle unit 5, the mixing tube unit 6, and the burner frame 11 on the heat insulator 13, a pot mount 131, nozzle unit mount 132, mixing tube unit mount 133, and frame mount 134 are respectively formed in the heat insulator 13.

Specifically, with the burner system mounted in the respective mounts, the burner system is enclosed by the heat insulator 13 on all sides except the top. Thus, the heat generated from the respective components of the burner system can be simultaneously prevented from being transferred to the outside. In addition, heat transfer between the respective components of the burner system can be blocked.

Here, each mount is formed corresponding to the components of the burner system. That is, in the case of the two larger burner pots 4 that receive a gas mixture in a direction from the rear-to-front of the heating cooking appliance, the mixing tube unit mount 133 and the nozzle unit mount 132 are sequentially formed rearward from the pot mounts 131.

On the other hand, in the case of the middle, smaller-sized burner pot 4, gas mixture is supplied from front-to-rear of the heating cooking appliance, so that the mixing tube unit mount 133 and the nozzle unit mount 132 are formed frontward from the pot mount 131.

Here, the burner frames 11 extend rearward from the burner pots 4, and a frame mount 134 is respectively formed at the rear of the heat insulator 13 to mount each burner frame 11.

Tube insert slots 135 in which the gas supply line 9 is inserted is formed in the heat insulator 13 to correspond to the layout of the gas supply line 9. In this case, the heat insulator 13 can further block heat transferred along the gas supply line 9.

In order to install the heat insulator 13 in the above configuration, the heat insulator 13 is first placed in the case 2. Then, the burner pots 4 and mixing tube units 6 are placed on the heat insulator 13, and the nozzle unit 5 and the gas supply line 9 coupled to the nozzle unit 5 are mounted at the same time, completing the installation.

Accordingly, in the present embodiment, the burner system is supported by the heat insulator 13, so that a separate supporting member for supporting the burner system and securing its position is not required.

The heat insulator 13 is configured to block heat by simply placing the heat insulator 13 on the case 2. Thus, assembly during manufacturing can be facilitated, manufacturing cost can be reduced, and the installation time for the heat insulator 13 can be drastically cut, reducing the overall manufacturing time.

Here in the present embodiment, a single heat insulator may be placed on all the burner systems to block heat; alternately, respective heat insulators may be provided in a number corresponding to the number of burner systems. In this case, each of the heat insulators are installed in the case, and the respective burner systems are seated on the respective heat insulators, so that a separate supporting member is not required and the manufacturing time of the product can be reduced.

Likewise, the heat insulator especially blocks the transfer of combustion heat to the case 2, and the warm zone guide 14 prevents the transfer of the combustion heat to the ceramic plate 1.

Figure 12:
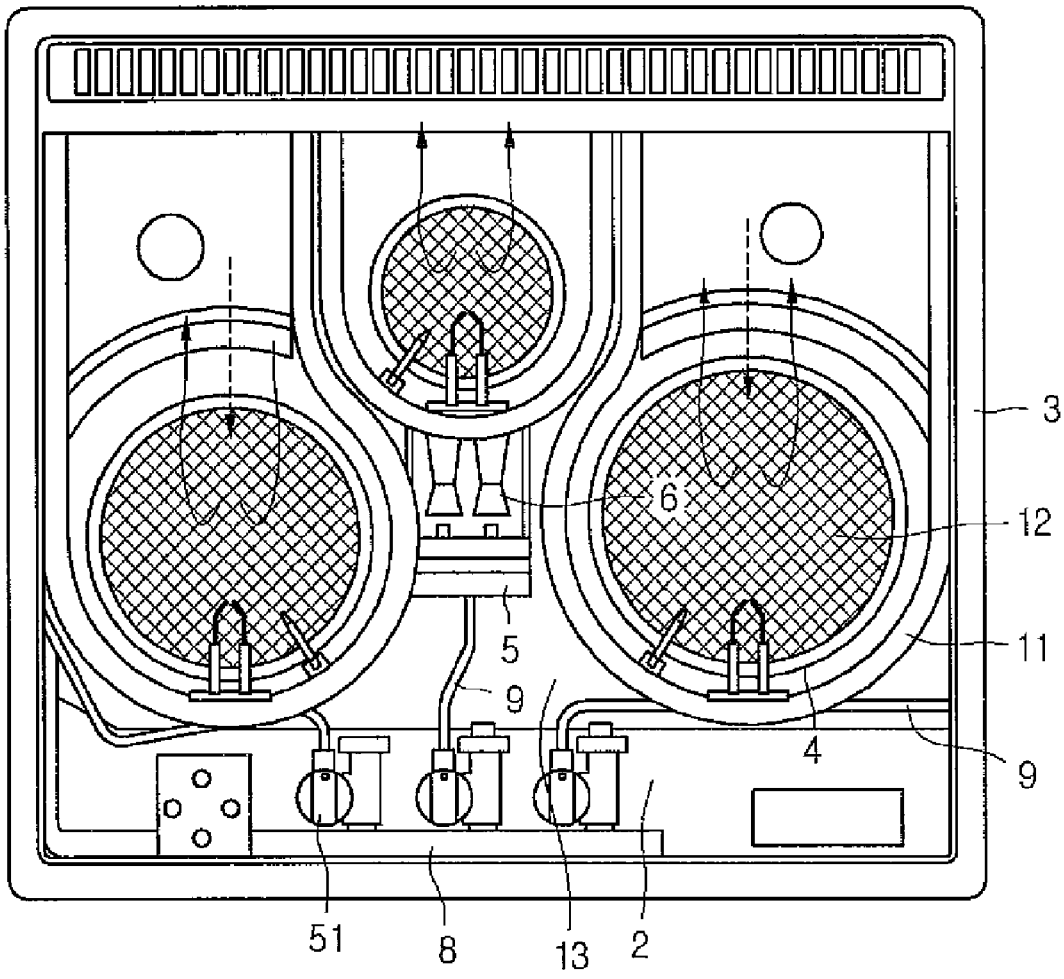
FIG. 12 is a plan view showing the inlets and outlets for air passing through burner pots according to the first embodiment.

FIG. 12 is a plan view showing the inlets and outlets for air passing through burner pots according to the first embodiment.

Referring to FIG. 12, in a burner system disposed on either side of a heating cooking appliance, after a gas mixture enters through the front, the gas mixture is mixed sufficiently in a first stage within the burner pot 4. Then, the gas mixture moves upward through the glow plate 12 and combusts, after which the spent gas is exhausted toward the rear.

In this burner system according to the present embodiment, sufficient collision amongst the gas mixture occurs within the burner pot 4 to create sufficient turbulence. Therefore, the moving velocity components of the gas mixture that were originally moving forward are negated, and mixing of air and gas inside the entire burner pot 4 occurs. Then, the gas combustion takes place as the gas mixture rises through the glow plate 12, where the combusting gas moves uniformly therethrough.

Therefore, in a burner system with burners on either side of the above heating cooking appliance, despite the flow directions of inflowing and discharged gas being opposed with respect to the center of the burner system, gas is able to flow without any flow resistance.

The present embodiment may be applied to a food preserving function of a cook top type heating cooking appliance, and the operating modes of the heating cooking appliance may be varied to provide convenience to users.

Also, without the addition of other complex components, food warming can be performed using only the warm zone guide provided on the exhaust passage, to substantially reduce manufacturing costs.

Further, excessive heating of regions of the ceramic plate other than the heating regions and warming regions is prevented, contributing to the safety of users and preventing discoloring or burning of proximate kitchen furnishings.

In addition, a separate supporting member is not required to support the burner system, because the burner system is supported on the heat insulator that blocks the transfer of combustion heat to the outside.

Still further, because a single heat insulator is placed within the case and the burner system is positioned on the heat insulator, the heat insulator itself costs less, and the time expended to install the heat insulator is reduced, reducing the overall manufacturing time of the product.

Second Embodiment

The second embodiment is characterized in that all portions are the same as in the first embodiment, with the exception of the opening defining the warm zone region being of a different shape. Thus, unaddressed aspects are covered by the pertinent descriptions in the first embodiment.

Figure 13:
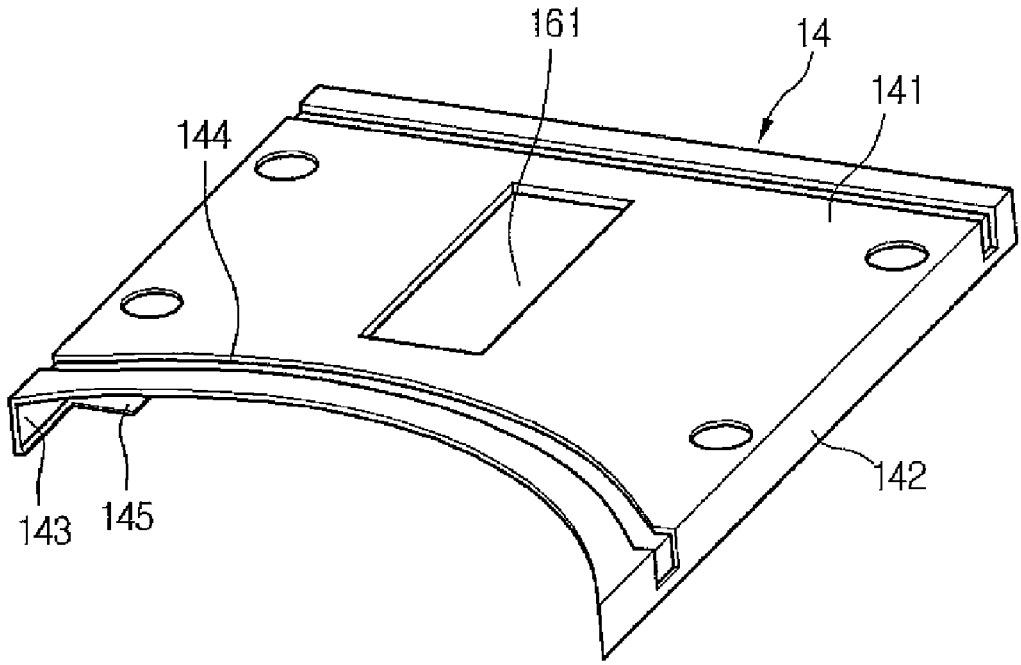
FIG. 13 is a perspective view of a warm zone guide according to the second embodiment.

FIG. 13 is a perspective view of a warm zone guide according to the second embodiment.

Referring to FIG. 13, the opening 161 in the present embodiment has a rectangular shape elongated in one direction. By being provided in a rectangular shape, food in a large-sized container can be effectively warmed.

Of course, the opening 161 may be provided in alternate shapes.

Third Embodiment

The third embodiment is characterized in that all portions are the same as in the first embodiment, with the exception of the opening defining the warm zone region being altered. Thus, unaddressed aspects are covered by the pertinent descriptions in the first embodiment.

Figure 14:
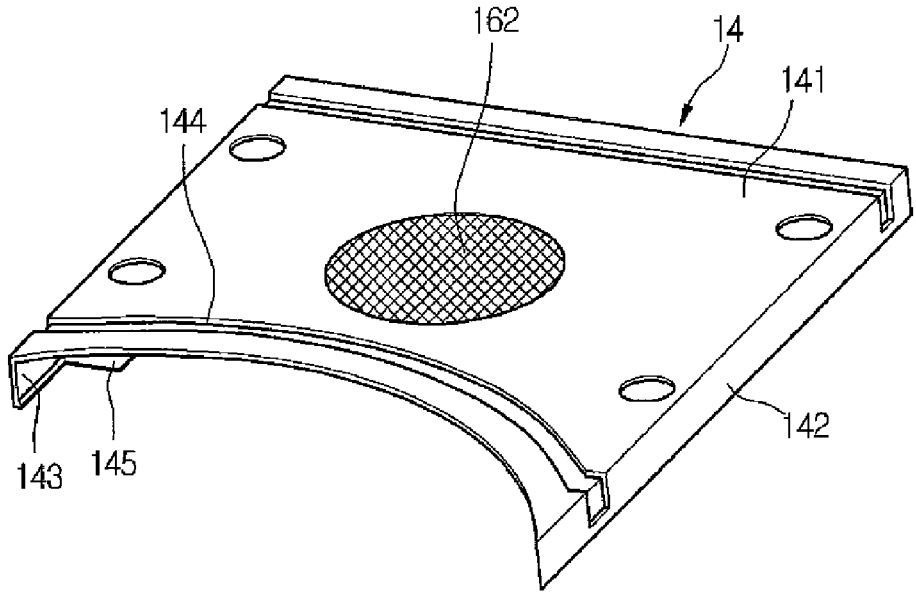
FIG. 14 is a perspective view of a warm zone guide according to the third embodiment.

FIG. 14 is a perspective view of a warm zone guide according to the third embodiment.

Referring to FIG. 14, in the present embodiment, a heat accumulator 162 is placed on the warm zone guide 14 in a region corresponding to the warm zone indicator of the ceramic plate. The use of such a heat accumulator 162 is to implement the food warming function over a longer duration.

For example, when the heating cooking appliance is operating, the heating region on the ceramic plate may be used for heating food, and the warm zone region may be used for warming food. However, when the heating cooking appliance is not operating, because the warm zone region cannot be used if the heating cooking appliance is not turned on, when a user wishes to warm food for a certain duration after the heating cooking appliance is turned off, the heating cooking appliance must be continuously operated for a certain duration.

To overcome these limitations, in order to enable the heating cooking appliance to maintain the temperature for a certain duration in the warm zone region after the appliance is switched off, a separate heat accumulator 162 is installed in the opening according to the first embodiment. Under these conditions, at the operating stage of the heating cooking appliance when the warm zone region is not required, the warm zone region is gradually increased in temperature, and after the heating cooking apparatus is switched off and the warm zone region is needed, the residual heat is gradually radiated, so that the warming feature of the heating cooking apparatus can function more effectively. Of course, this is also able to reduce fuel consumption. The heat accumulator may be provided respectively at both the top and bottom of the warm zone guide.

Fourth Embodiment

The fourth embodiment is characterized in that all portions are the same as in the first embodiment, with the exception of the warm zone guide being altered. Thus, unaddressed aspects are covered by the pertinent descriptions in the first embodiment.

Figure 15:
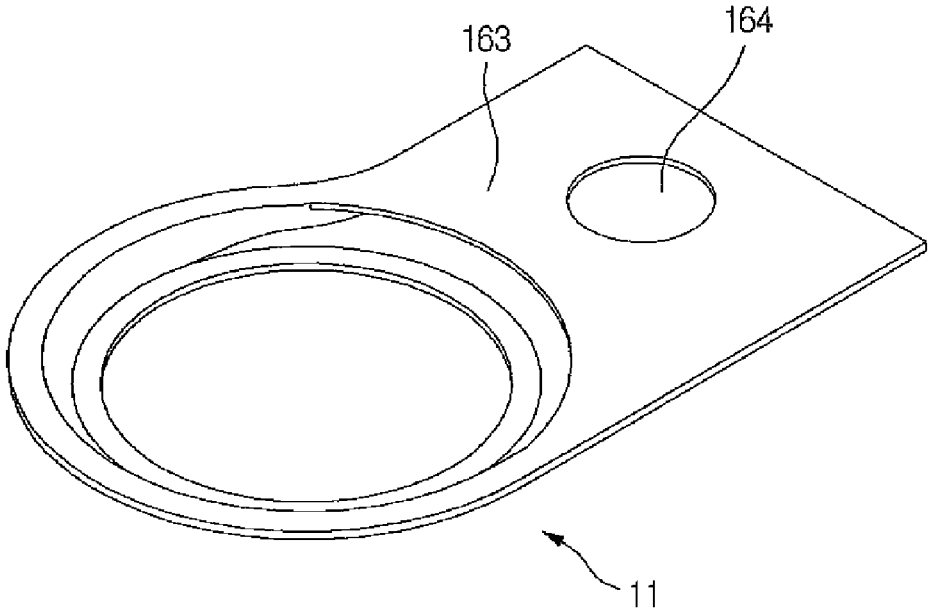
FIG. 15 is a perspective view of a warm zone guide according to the fourth embodiment.

FIG. 15 is a perspective view of a warm zone guide according to the fourth embodiment.

Referring to FIG. 15, the warm zone guide 163 according to the present embodiment is integrally formed with a burner frame 11.

Specifically, the warm zone guide 163 extends horizontally from an upper end of the burner frame 11. The warm zone guide 163 defines the top surface of the exhaust passage 111. The warm zone guide 163 defines an opening 164 that designates the warm zone region.

The present embodiment is not limited to the above, and may include the embodiments below.

First, although the exhaust passage has been described as extending rearward, it is not limited thereto, and may direct exhaust in any direction with respect to the ceramic plate. Moreover, the warm zone region may be provided at any region corresponding to the location of the exhaust passage.

Also, in order to thermally seal the region formed by the exhaust passage more effectively, the warm zone guide may be formed thicker or include an added insulating material.

The left wall 143 and the right wall 142 are described as being the only portions of the warm zone guide 14 contacting the burner frame; however, in order to quickly transfer heat from the upper wall 141 to other areas, the warm zone guide 14 may be exposed to other parts within the heating cooking apparatus (and even made to contact other parts if required) and may contact a heat sink of a predetermined shape that is exposed to the outside.

The temperature of the warm zone region may be controlled by inserting a heat insulator between the upper wall of the warm zone guide and the undersurface of the ceramic plate so that heat from the upper wall is not directly conducted to the ceramic plate, or by preventing combustion gas from entering the gap between the ceramic plate and the warm zone guide.

Furthermore, the opening in the warm zone according to the present embodiment may not be provided. In this case, the heat transferred to the ceramic plate is dissipated to the outside in order to reduce the temperature of the ceramic plate. Here, the warm zone guide may be called a heat blocking member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating cooking appliance comprising:

a case;

a plate covering a top of the case;

a burner system provided below the plate, the burner system including a burner pot, a glow plate having a plurality of through holes through which a gas mixture passes and combusts, and a burner frame for exhausting combustion gas, the burner frame having a hole through which exhausted combustion gas passes; and a warm zone guide mounted on the burner frame, the warm zone guide including a plurality of side walls and an upper wall, the upper wall including an opening that exposes at: least a portion of an undersurface of the plate above the opening to the exhausted combustion gas, and the upper wall of the warm zone guide is spaced apart from the plate, wherein the plurality of side walls is seated on a portion of the burner frame, wherein the opening defines a warm zone region, and wherein the warm zone guide is formed separate from the burner frame.

2. The heating cooking appliance according to claim 1, wherein the warm zone guide blocks a transfer of heat from the combustion gas to surrounding areas of the warm zone region of the plate.

3. The heating cooking appliance according to claim 1, wherein the plate comprises a warm zone indicator indicating the warm zone region.

4. The heating cooking appliance according to claim 1, wherein the warm zone guide comprises a heat accumulator mounted thereon.

5. The heating cooking appliance according to claim 1, further comprising a heat insulator blocking a transfer of heat from the burner system to an outside.

6. The heating cooking appliance according to claim 5, wherein the burner system is mounted on the heat insulator.

7. The heating cooking appliance, according to claim 6, wherein the burner system is provided in plurality, and the heat insulator simultaneously thermally insulates the burner systems.

8. The heating cooking appliance according to claim 7, wherein the heat insulator simultaneously encloses the burner systems.

* * * * *